US006297177B1

(12) United States Patent
Belli et al.

(10) Patent No.: US 6,297,177 B1
(45) Date of Patent: Oct. 2, 2001

(54) DRUMHEAD CONSTRUCTION

(75) Inventors: Remo D. Belli; Gerardo Jose Reyes, both of Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 09/624,499

(22) Filed: Jul. 24, 2000

(51) Int. Cl.[7] ..... G10D 13/02

(52) U.S. Cl. ..... 442/242; 442/251; 442/253; 442/261; 442/286; 84/414

(58) Field of Search ..... 442/242, 251, 442/253, 261, 286; 84/414

(56) References Cited

U.S. PATENT DOCUMENTS 4,308,782 * 1/1982 Hartry ..... 84/414
4,362,081 * 12/1982 Hartry ..... 84/414
5,581,044 * 12/1996 Belli et al. ..... 84/144

* cited by examiner

*Primary Examiner*—Elizabeth M. Cole
(74) *Attorney, Agent, or Firm*—Rapkin & Gitlin; Larry F. Gitlin, Esq.

(57) ABSTRACT

A drumhead lamination comprising upper and lower layers of synthetic plastic sheet materials and a layer of impregnated polyester or natural fabric sheet material sandwiched in between the systhetic plastic layers. A substance employed to impregnate the fabric, typically a liquid resin, causes the fabric to harden and stiffen to enable it to vibrate synergistically in concert with the vibrating synthetic plastic layers when the drumhead is struck by a drumstick or a similarly hard object. Laminating adhesive is used to bond the layer together. Epoxy or a similar substance is applied to the top and bottom exposed surfaces of the drumhead as a protective coating.

15 Claims, 1 Drawing Sheet

DRUMHEAD CONSTRUCTION

BACKGROUND OF THE INVENTION

The present invention relates generally to the area of drumhead construction and, more particularly, to a laminated head for a drum that includes at least two layers of synthetic plastic sheet materials and a layer of polyester or natural fiber fabric material, which is impregnated throughout with a liquid agent and bonded between the plastic sheet materials to enable the laminate to vibrate synergistically when struck by an object.

HISTORY OF THE PRIOR ART

Drumheads produced from a variety of materials are well know in the prior art. Animal skins were the first materials used to fabricate drumheads and then later synthetics became the materials of choice for the large majority of heads, particularly for those drums used to play rock, jazz and generally all varieties of contemporary music.

In contrast, animal skins have been used from the earliest of times to the present to play ethnic music. Examples of drums used to play ethnic sounds are the conga, bongo and djimbe. Natural skins, for the most part, have been preferred over synthetic materials because the sounds they produce are warm in tone. When an object strikes the head, a fundamental note is produced usually with minimal overtones. These overtones are best described as the attendant higher tones heard together with a fundamental note having a frequency of vibration that is a multiple of the fundamental note's frequency. The effect produced by the overtones is a significant disturbance of the sound, and a lessening of its quality. With a head fashioned from a natural animal skin, sound decay is relatively short (est. between 500 to 600 ms). Consequently, each note of a musical composition can be articulated.

In contrast, the synthetic materials, especially the plastics, which in many instances have been substituted for the animal skins, produce what is often described as a "pingy" sound when the drumhead is struck. The resulting sound, unlike the sounds produced by a head fashioned from an animal skin, contains many dissonant overtones. The residual high pitch ringing heard after the head is struck (commonly called "after ring") is also a problem with heads fashioned from synthetic materials. After ring occurs when the primary and secondary notes decay at longer intervals, and mix. The result typically is a displeasing musical sound of inarticulate notes. Despite these problems, synthetic heads still have a distinct advantage over the natural skins, including the strength of the material itself and the ability to withstand the negative effects of moisture and temperature brought about by changing weather conditions. Skins can become either extremely dry or brittle. If the air is heavily humidified, skins become moist and eventually lose their tautness. In either case, it becomes increasingly difficult to maintain the desired sound consistency, and the musical quality suffers.

The present invention solves these problems in the prior art by employing a lamination of plastics and impregnated synthetic or natural fabrics which, through synergy, combine the best aspects of a head made from natural skin, including the warm and minimal overtones, and the advantages of synthetic materials, including the resistance to moisture and temperature changes.

SUMMARY OF THE INVENTION

The present invention provides for a lamination comprising an upper and a lower layer of synthetic plastic sheet materials and a layer of impregnated natural fabric sheet material sandwiched in between the two plastic layers. The substance employed to impregnate the fabric, typically a liquid or resin, causes the fabric to harden and stiffen to enable it to vibrate synergistically in concert with the vibrating synthetic plastic layers on either side.

The preferred lamination of the present invention includes upper and lower layers of synthetic plastic sheet materials and a layer of impregnated natural fabric sheet material sandwiched in between the synthetic plastic layers. Laminating adhesive is used to bond the layers together. Epoxy or a similar substance is normally applied to the top and bottom exposed surfaces of the drumhead as a protective coating.

Alternative embodiments of the present invention include the preferred embodiment of the present invention at the core or as a common component situated somewhere within the lamination. These other embodiments may include several layers of plastic and impregnated fabric sheet materials in various combinations. For example, one such embodiment includes a combination of materials in the following sequence (top to bottom): plastic, fabric, plastic, plastic, fabric. Another embodiment includes laminate materials in the following sequence (top to bottom): plastic, fabric, plastic, plastic, fabric, plastic. Substances used to impregnate the fabric may vary with the preferred and alternate embodiments. The sheet materials of the alternative embodiments are bonded together in the same manner as the materials are bonded in the laminate of the preferred embodiment. Protective coatings are similarly applied to the exposed surfaces of the laminates of the alternative embodiments.

The preferred and various alternate embodiments of the present invention generally correlate with the type of drum for which a specific drumhead is intended. For example, congas, bongos and djimbes will normally employ drumhead laminates having different thicknesses to achieve a distinct sound. Generally, the thickness of the drumhead depends on the number of plastic and fabric layers combined to comprise the lamination, although fewer, but thicker, individual layers can result in the same thickness.

Accordingly, an object of the present invention is to provide a laminated drumhead of a drum or similar musical instrument that includes a top and bottom plastic layer and an impregnated fabric layer sandwiched in and bonded between the two plastic layers.

Another object of the present invention is to provide a laminated drumhead of a drum or similar musical instrument that uses a liquid or resin to impregnate a fabric material bonded between individual layers of plastic materials to enable the impregnating substance, when hardened, to stiffen the fabric so that the fabric and the plastic layers vibrate synergistically.

Still another object of the present invention is to provide a laminated drumhead of a drum or similar musical instrument with the means to subdue the higher frequency dissonant notes inherent in plastic drumheads while retaining the desired crispness of the sound.

Yet another object of the present invention is to provide a laminated drumhead of a drum or similar musical instrument with the means to retain the strength of a plastic laminated drumhead without the inherent undesirable plastic sound.

Still another object of the present invention is to provide a laminated drumhead of a drum or a similar musical instrument with a top and a bottom plastic layer and an impregnated fabric layer sandwiched in between that produces sounds substantially similar, if not identical, to the sounds normally produced by a drumhead fashioned from a natural animal skin.

Still yet another object of the present invention is to provide a laminated drumhead of a drum or a similar musical instrument that has the look and feel of a drumhead fashioned from a natural animal skin.

Still yet another object of the present invention is to provide a laminated drumhead of a drum or a similar musical instrument that can be easily and efficiently manufactured.

Other objects and advantages of the present invention will become apparent in the following specifications when considered in light of the attached drawings wherein a preferred embodiment of the invention is illustrated.

DETAILED DESCRIPTION OF THE PREFERRED EMBODIMENT

Figure 1:
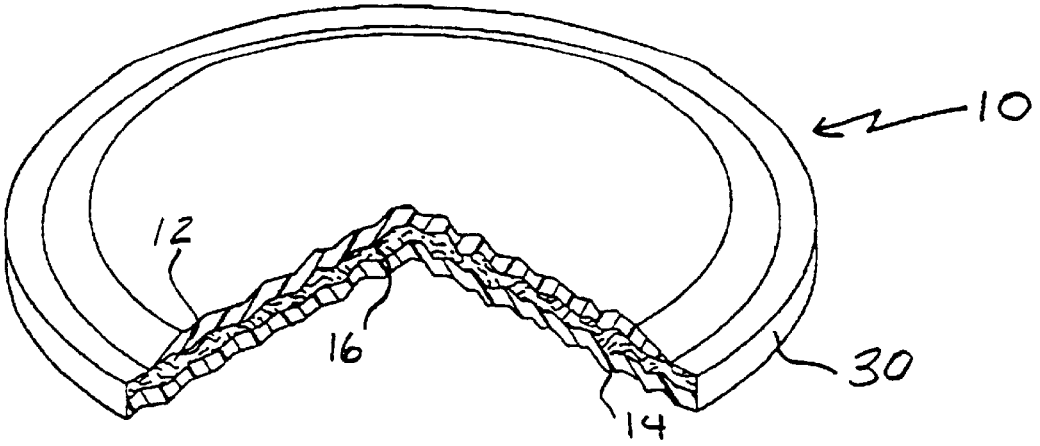
FIG. 1 is a perspective view showing a laminated head of the preferred embodiment of the present invention having a top and bottom surface of synthetic plastic sheet materials and an impregnated middle layer of a synthetic or natural fabric sheet material adhered to the synthetic plastic sheet materials, and mounted on a hoop.
Figure 2:
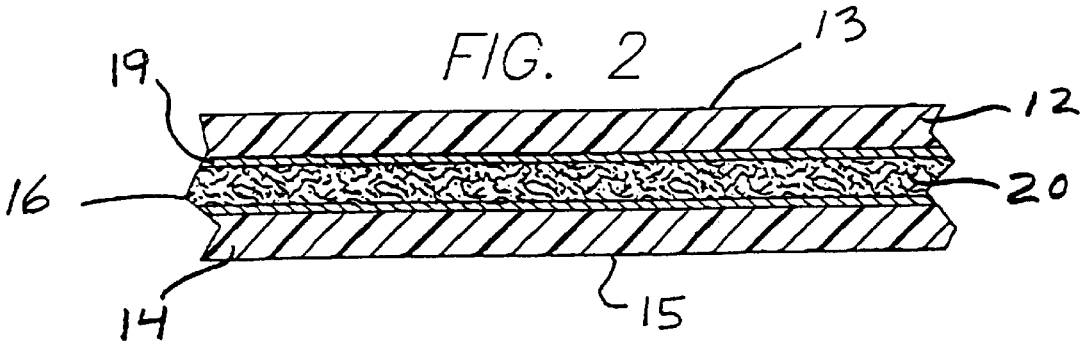
FIG. 2 is a cross-sectional view of the laminated head of the preferred embodiment of the present invention showing the impregnated synthetic or natural fabric material layer laminated between top and bottom layers of synthetic plastic sheet materials using an adhesive resin composition to adhere the layers together.

The preferred embodiment of the present invention, as shown in FIGS. 1 and 2, provides a drumhead construction 10 comprising a laminate of synthetic plastic sheet materials 12 and 14 bonded to a single sheet of synthetic or natural fabric material 16. The fabric material 16, which, depending upon its composition, may be the woven or non-woven variety, typically is "sandwiched" between single layers of synthetic plastic sheet materials 12 and 14 which are adhered to each side of the fabric using a resin composition 19, such as ethylene vinyl acetate ("EVA") or some other suitable adhesive substance employed for this purpose. The fabric material 16 can be impregnated with one of several different substances 20 which include, without limitation, sodium silicate, starch and epoxy resin. The thicknesses of the individual synthetic or natural sheet materials comprising the laminate may vary. The estimated range of thicknesses of the plastic sheet materials is from 3 mls to 20 mis. The estimated range of thicknesses of the fabric sheet materials is 2 mls to 30 mls. Two component 100% solid epoxies 13 and 15 are applied as a protective coatings to the exposed surfaces of the top and bottom layers of synthetic sheet materials A variety of synthetic plastic sheet materials may be used to practice the present invention, including, without limitation, MYLAR®, which is the registered trademark of E.I. duPont de Nemours & Co., Inc., the producer. The preferred MYLAR® is a heat shrinkable film. Other synthetic plastic sheet materials may also be employed, including those sold under the trademarks MELINEX®, produced by ICI Americas, Inc.; CELENAR® produced by Celenese Plastic Co., Inc.; and SCOTCHPAR® produced by the 3M Co. Suitable synthetic fabric materials with random fiber orientation may be used to practice the present invention, including, without limitation, TYPELLE® (type 5300), KEVLAR®, TYVEK®, and NOMEX®, all produced by E.I. duPont de Nemours & Co., Inc. Suitable natural fabric material is cotton batting sold under the traemarks WARM & NATURAL® and WHITE™.

Figure 3:
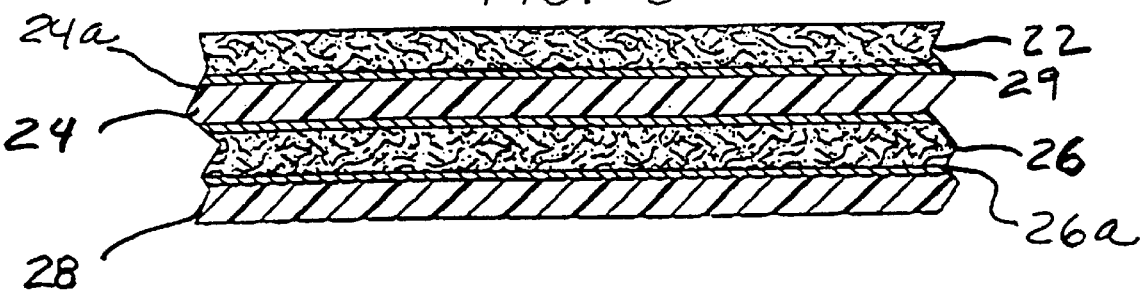
FIG. 3 is a cross-sectional view of an alternate embodiment of the present invention showing an impregnated synthetic or natural fabric material layer laminated between a top and a bottom layer of synthetic plastic sheet materials and a second impregnated synthetic or natural fabric material layer laminated to the top layer of synthetic plastic sheet material using a resin composition to adhere the layers together.

Alternate embodiments, including the embodiment shown in FIG. 3, include a sheet of impregnated synthetic fabric material 22 adhered to the upper surface 24*a* of a sheet of plastic material 24 which, in turn, is adhered to a sheet of impregnated synthetic fabric material 26, which is sandwiched between plastic material 24 and a second sheet of synthetic plastic material 28 adhered to the fabric's 26 lower surface 26*a*. An adhesive composition 29, such as EVA, is used to adhere and bond the layers together.

Other alternative embodiments, as shown below, include drumhead laminates comprising one or more adhered layers of synthetic plastic sheet and fabric sheet materials situated above and/or below the laminate comprising the preferred embodiment of the present invention, i.e. the impregnated fabric material 16 sandwiched between the two layers of synthetic plastic sheet materials 12 and 14. Thus, additional alternate embodiments of the present invention include the following:

1. Thin Skin Conga Head
   (Top) Layer 1: 7.5 mil Mylar®
   Layer 2: Fabric impregnated with sodium silicate
   Layer 3: 7.5 mil Mylar®
   Layer 4: Fabric impregnated with sodium silicate
   Layer 5: 7.5 mil Mylar®
2. Medium Skin Conga Head
   (Top) Layer 1: 7.5 mil Mylar®
   Layer 2: Fabric impregnated with sodium silicate
   Layer 3: 7.5 mil Mylar®
   Layer 4: 7.5 mil Mylar®
   Layer 5: Fabric impregnated with sodium silicate
   Layer 6: 7.5 mil Mylar®
3. Thick Skin Conga Head
   (Top) Layer 1: 7.5 mil Mylar®
   Layer 2: Fabric impregnated with sodium silicate
   Layer 3: 7.5 mil Mylar®
   Layer 4: 7.5 mil Mylar®
   Layer 5: Fabric impregnated with sodium silicate
   Layer 6: 7.5 mil Mylar®
   Layer 7: TYVEK®
4. Thin Skin Bongo Head
   (Top) Layer 1: 7.5 mil Mylar®
   Layer 2: Fabric impregnated with sodium silicate
   Layer 3: 7.5 mil Mylar®
5. Thick Skin Bongo Head
   (Top) Layer 1: TYVEK®
   Layer 2: 7.5 mil Mylar®
   Layer 3: Fabric impregnated with sodium silicate
   Layer 4: 7.5 mil Mylar®

To bond the layers of the lamination together, EVA or some other suitable adhesive agent is applied to one or both sides of the plastic and fabric sheet materials, as appropriate. In all the embodiments, the thickness of the fabric is typically in the range of 2 to 40 mls, though this could vary.

As with the preferred embodiment of the present invention, the synthetic plastic sheet and fabric sheet materials used to form the alternative embodiments may range in thickness from an estimated 3 mls to 20 mls for plastic and an estimated 2 mls to 40 mls for fabric. Adhesive compositions and impregnating agents may also vary depending on a variety of factors, including, without limitation, the tonal, tactile, appearance and other unique requirements of the particular drumhead construction. Also, an epoxy protective coating is normally applied.

In practice, the drumhead construction of the preferred embodiment of the present invention comprises a laminate consisting of three layers, one sheet of synthetic or natural fabric material 16 and two sheets synthetic plastic materials 12 and 14. Initially, the fabric layer is in the range of 2 to 40 mls thick and is impregnated with a specific chemical agent, such as, for example, sodium silicate, starch or epoxy resin. This agent is applied to the fabric utilizing any conventional manner of application, such as a device for rolling the agent on to and working it into the fabric. In the process, the fabric, which appears puffedup in its non-impregnated state, absorbs the impregnating agent and eventually becomes matted down and compressed.

Each sheet of the plastic material is typically 7.5 mls thick. EVA may be employed as a pre-coated bonding agent (approx. 1.5 ml thick) to adhere the layers together. The outer or exposed surfaces of the plastic are sanded or "roughed up" to give the head a natural or genuine animal skin appearance and feel. Epoxy is then applied to the exposed surfaces of the laminate as a protective coating, and allowed to cure. When the construction is mounted into a hoop 30, the look is nearly identical to a genuine animal skin giving the head an authentic ethnic appearance.

The drumhead laminate of the present invention acts to soften the higher frequency notes that are inherent in plastic drumheads generally. The invention contributes to the unique character of the sounds and assists to retain their crispness without allowing the sound to be dampened too much in the process. With the contribution of the impregnated fabric, which cures to a rigid state, and the lamination of the fabric to the plastic sheet materials, the invention, through synergy, achieves a drumhead that looks and sounds more natural.

Depending on the overall construction of the laminate and the specific composition of its components, e.g. the number of individual layers of synthetic or natural materials, the ratios of plastic sheet materials to fabric, the relative thicknesses of the various sheets of synthetic or natural materials and the ingredients of the impregnating, adhesive and protective coating agents, the drumhead of the present invention is capable of adopting a variety of looks and producing a broad spectrum of unique, pleasing and different sounds.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A head for a musical drum comprising a first synthetic plastic sheet material with an exposed surface, a second synthetic plastic sheet material with an exposed surface, a sheet of fabric material bonded between and to said first and second synthetic plastic sheet materials, and a means employed to impregnate in a generally uniform manner said sheet of fabric material to enable the fabric material to harden and stiffen and thereby vibrate synergistically with said first and second synthetic plastic sheet materials to produce a fundamental note with minimal overtones and enhance the articulation of said note, resulting in a natural skin sound when said head is struck by a drum stick or another hard object.

2. The head of claim 1 wherein said means to impregnate comprises sodium silicate.

3. The head of claim 1 wherein said means to impregnate comprises epoxy resin.

4. The head of claim 1 wherein said means to impregnate comprises starch.

5. The head of claim 1 wherein said fabric sheet material is synthetic.

6. The head of claim 1 wherein said fabric sheet material is natural.

7. The head of claim 1 wherein said fabric sheet material is woven.

8. The head of claim 1 wherein said fabric sheet material is non-woven.

9. The head of claim 1 wherein said first and second synthetic plastic sheet materials and said fabric sheet material are bonded together by adhesive.

10. The head of claim 1 wherein epoxy is applied to the exposed surfaces of the drum head as a protective coating.

11. A head for a musical drum comprising, a first sheet of synthetic plastic material, a second sheet of synthetic plastic material, a first sheet of fabric material situated between and bonded to said first and second sheets of synthetic plastic materials, a third sheet of synthetic plastic material bonded to said second sheet of synthetic plastic material, a second sheet of fabric material bonded to said third sheet of synthetic plastic material, and means employed to impregnate said first and second sheets of fabric materials to enable said first and second sheets of fabric materials to harden and stiffen and thereby vibrate synergistically with said first, second and third sheets of synthetic plastic materials to produce a fundamental note with minimal overtones and enhance the articulation of said note, resulting in a natural skin sound when said head is struck by a drum stick or another hard object.

12. A head for a musical drum comprising a first sheet of synthetic plastic material, a second sheet of synthetic plastic material, a first sheet of fabric material situated between and bonded to said first and second sheets of synthetic plastic materials, a third sheet of synthetic plastic material bonded to said second sheet of synthetic plastic material, a second sheet of fabric material bonded to said third sheet of synthetic plastic material, a fourth sheet of synthetic plastic material bonded to said second sheet of fabric material, and means employed to impregnate said first and second sheets of fabric materials to enable said sheets of fabric materials to harden and stiffen and thereby vibrate synergistically with said first, second, third and fourth sheets of synthetic plastic materials to produce a fundamental note with minimal overtones and enhance the articulation of said note, resulting in a natural skin sound when said head is struck by a drum stick or another hard object.

13. A head for a musical drum comprising a first sheet of synthetic plastic material, a second sheet of synthetic plastic material, a first sheet of fabric material situated between and bonded to said first and second sheets of synthetic plastic materials, a third sheet of synthetic plastic material bonded to said second sheet of synthetic plastic material, a second sheet of fabric material bonded to said third sheet of synthetic plastic material, a fourth sheet of synthetic plastic material bonded to said second sheet of fabric material, a third sheet of fabric material bonded to said fourth sheet of synthetic plastic material, and means employed to impregnate said first, second and third sheets of fabric materials to enable said sheets of fabric materials to harden and stiffen and thereby vibrate synergistically with said first, second, third and fourth sheets of synthetic plastic materials to produce a fundamental note with minimal overtones and enhance the articulation of said note, resulting in a natural skin sound when said head is struck by a drum stick or another hard object.

14. A head for a musical drum comprising a first sheet of synthetic plastic material with a top surface, a second sheet of synthetic plastic material, a first sheet of fabric material situated between and bonded to said first and second sheets of synthetic plastic materials, a second sheet of fabric material bonded to the top surface of said first sheet of synthetic plastic material, and means employed to impregnate said first and second sheets of fabric materials to harden and stiffen and thereby vibrate synergistically with said first and second sheets of synthetic plastic materials to produce a fundamental note with minimal overtones and enhance the articulation of said note, resulting in a natural skin sound when said head is struck by a drum stick or another hard object.

15. A head for a musical drum comprising a first synthetic plastic sheet material with an exposed surface, a second synthetic plastic sheet material with an exposed surface, a sheet of woven fabric material bonded between and to said first and second synthetic plastic sheet materials, and a means emp ate in a generally uniform manner said sheet of fabric material to enable the fabric material to harden and stiffen and thereby vibrate synergistically with said first and second synthetic plastic sheet materials to produce a fundamental note with minimal overtones and enhance the articulation of said note, resulting in a natural skin sound when said head is struck by a drum stick or another hard object.

* * * * *

UNITED STATES PATENT AND TRADEMARK OFFICE

CERTIFICATE OF CORRECTION

PATENT NO. : 6,297,177 B1
DATED : October 22, 2001
INVENTOR(S) : Remo D. Belli, Gerardo Jose Reyes It is certified that error appears in the above-identified patent and that said Letters Patent is hereby corrected as shown below:

Title page,
Item [57], ABSTRACT,
A drumhead lamination comprising upper and lower layers of synthetic plastic sheet materials and a layer of impregnated polyester or natural fabric sheet material sandwiched between the (systhetic) synthetic plastic layers. A substrance employed to impregnate the fabric, typically a liquid or resin, causes the fabric to harden and stiffen to enable it to vibrate synergistically in concert with the vibrating synthetic plastic layers when the drumhead is struck by a drumstick or a similarly hard object. Laminating adhesive is used to bond the (layer) layers together. Epoxy or a similar substance is applied to the top and bottom exposed surfaces of the drumhead as a protective coating.

Column 8,
Line 23, a means (emp) (ate) employed to impregnate in a generally uniform manner said sheet....

Signed and Sealed this

Twenty-sixth Day of March, 2002

*Attest:*

*Attesting Officer*

JAMES E. ROGAN
*Director of the United States Patent and Trademark Office*